United States Patent [19]

Carithers, Jr.

[11] Patent Number: 4,747,330

[45] Date of Patent: May 31, 1988

[54] MAT CUTTING SYSTEM

[76] Inventor: Charles H. Carithers, Jr., 5752A Galland Dr., Jackson, Miss. 39236

[21] Appl. No.: 936,381

[22] Filed: Dec. 1, 1986

[51] Int. Cl.[4] ..... B26D 3/02

[52] U.S. Cl. ..... 83/467 A; 83/455; 83/468; 83/581; 83/614

[58] Field of Search ..... 83/455, 456, 581, 467–468, 83/614; 269/303, 304, 319

[56] References Cited

U.S. PATENT DOCUMENTS

| | | | |
|---|---|---|---|
| 3,213,736 | 10/1965 | Keeton | 83/455 |
| 3,779,119 | 12/1973 | Broides | 83/581 |
| 3,973,459 | 8/1976 | Stowe | 83/581 X |
| 3,996,827 | 12/1976 | Logan | 83/614 |
| 4,413,542 | 11/1983 | Rempel | 83/455 |
| 4,505,174 | 3/1985 | Carithers, Jr. | 83/455 |

*Primary Examiner*—Frank T. Yost

*Attorney, Agent, or Firm*—Larson and Taylor

[57] ABSTRACT

A system for the precision cutting of picture mats includes a flat base on which an elongate mounting arm is provided. A mat guide bar is adjustably and detachably mounted to the mat guide bar and includes a first mat engaging edge surface and opposed edge surface. A mat cutter device is also mounted on the base for cutting a mat along a line parallel to the first edge surface. A plurality of bar stops are provided which include opposed flat sides and a bar stop mounting mechanism for detachably mounting each bar stop to the mounting arm. The bar stops are mounted so that opposed flat sides are positioned parallel to the edge surfaces of the mat guide bar for selective abutment therewith. Two mat stops are also provided which include a second mat engaging surface. These mat stops are detachably mounted to the guide bar. The second engaging surface is adjustable with respect to the first edge surface of the mat guide bar. Preferably, the bar stops are adapted to receive an elongate cross member therein. A depending stop is attached at the distal end of the cross member which is adjustably positioned into and out of abutting engagement with the mat guide bar. The cross member is also preferably adjustably mounted to the bar stop. Each second mat engaging edge surface of the associated mat stop is adjustable by the addition of one or more of a plurality of blocks.

12 Claims, 3 Drawing Sheets

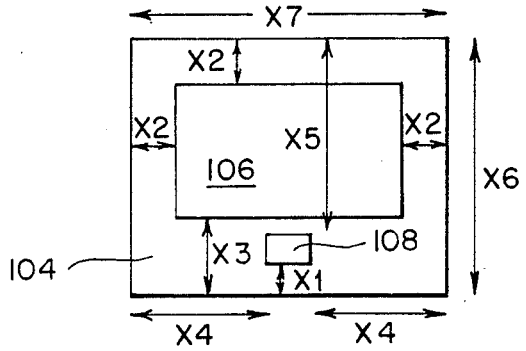
FIG. 7A
FIG. 7B
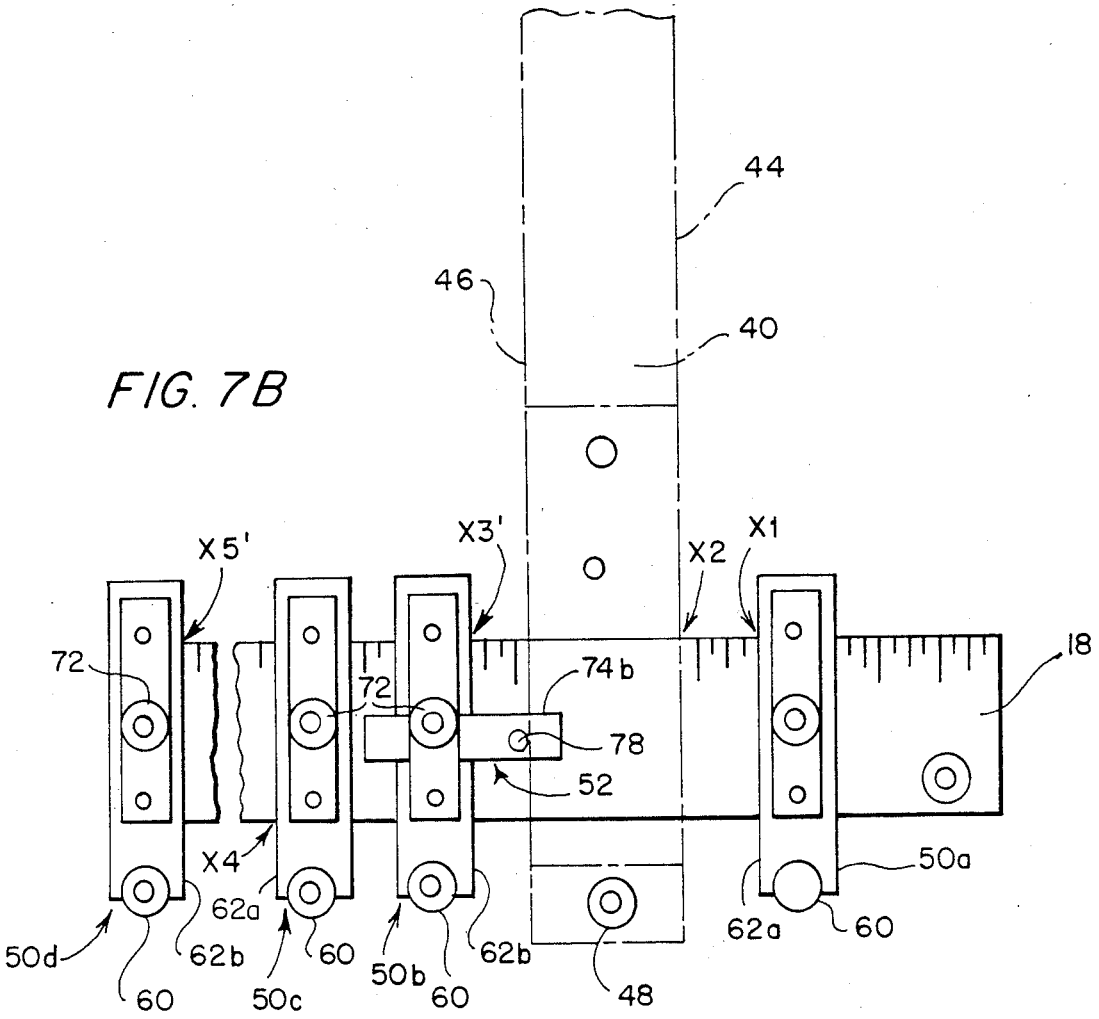

MAT CUTTING SYSTEM

FIELD OF THE INVENTION

The present invention relates generally to a system for cutting picture mats, and more particularly to a mat cutting system whereby double mats, off-center opening mats, and complex shaped opening mats are easily and quickly cut.

BACKGROUND OF THE INVENTION

Various mat cutter systems have been disclosed in the prior art for making the cutting of mats easier. For example, in U.S. Pat. No. 4,413,542 (Rempel) a mat cutter and guide system is provided which includes a rectangular cutting base and a novel clamping frame. A cutting blade is mounted on the base between adjustable stops. A repeater and duplicator adjustment mechanism is also provided in order to cut different widths of the sides of the mat opening as well as to provide a second mat with a slightly smaller opening.

Disclosed in U.S. Pat. No. 3,527,131 (Ellerin et al) is a mat cutter device for trimming art mats. The mat cutter includes a ways in which a cutter is mounted. Above the ways is a rod on which suitable stops are adjustably located to define the length of the cut as the cutter moves between the two stops. Located to one side of the base is a straight edge ruler which acts as a squaring stop for locating a work piece and as a scale by which to set a depth stop. Another mat cutter provided with stops for the cutter blade is disclosed in U.S. Pat. No. 3,996,827 (Logan). Adjustable stops are also provided on the squaring angle in order to locate the edge of the picture mat at a desired position. Still another cutter device with stops for a cutting mechanism is disclosed in U.S. Pat. No. 3,213,736 (Keeton).

In U.S. Pat. No. 4,505,174 (Carithers, Jr.), an automatic mat cutting apparatus is disclosed in which the size of the opening to be cut is adjustable. It is further disclosed that suitable switches or stops can be connected to the control means to precisely control the length of travel of each mat cutter. The position of the cutting blade can also be adjusted simply by moving the support thereof left to right to provide for the cutting of double mats.

Although the various mat cutting systems described above have been designed to make the cutting of picture mats easier, such systems have not proven adequate for all the varieties of openings to be cut in picture mats. In addition, the repeatability of certain cuts is limited by the requirement that exact placement of certain of the stops must be mainly repeated and this leads to a source of error in attempting to duplicate cuts.

SUMMARY OF THE INVENTION

In accordance with the present invention, a mat cutting system for the precision cutting of picture mats is provided. The system includes a flat base having a base surface upon which the picture mat to be cut is located. Also located on the base surface is a mounting arm which is attached to the base. This mounting arm extends in a direction parallel to the base surface. A mat guide bar including a first mat engaging edge surface and opposed edge surface parallel thereto, and a bar mounting means for adjustably and detachably mounting the mat guide bar to the mounting arm are also provided. When attached to the mounting arm, the first edge surface and opposed edge surface of the mat guide bar extend perpendicular to the direction of the mounting arm and perpendicularly from the base surface. A mat cutter means is mounted to the base for cutting the mat along a line parallel to the first edge surface of the mat guide bar. The mat cutter means extends parallel to the mat guider bar and along the base surface.

A plurality of bar stops are provided with each bar stop including a mounting means for detachably mounting the bar stop to the mounting arm. Each bar stop also includes opposed flat sides such that when the bar stop is attached to the mounting arm, the opposed flat sides are positioned parallel to the edge surfaces of the mat guide bar. Two mat stops are also provided with each mat stop including a mounting means for detachably mounting the mat stop to the mat guide bar. Each mat stop further includes a second mat engaging edge surface which is parallel to the first mat engaging surface. An adjustment means is also provided for adjusting the position of the second edge surface relative to the first edge surface of the mat guide bar.

With this mat cutting system, a rectangular opening having unequal borders is easily cut by moving the mat guide bar from abutting relationship with one of the bar stops to abutting relationship with another bar stop. In addition, a double mat having a smaller and congruent rectangular opening is similarly cut by cutting of the opening in the first mat and the subsequent placement of appropriately adjusted mat stops on the guide bar during the cutting of the congruent opening in the double mat.

In the preferred embodiment of the present invention, at least one of the bar stops includes an elongate cross member having a distal end. A cross member mounting means is provided for mounting the cross member to the bar stop such that the cross member extends perpendicular to respective opposed sides of the bar stops and parallel to the squaring arm with the distal end spaced from the first stop. A depending stop is attached adjacent the distal end so that the depending stop is engaged by the mat guide bar. This provides an additional positioning of the mat guide bar by abutting the mat guide bar against the depending stop. Preferably, the cross member mounting means includes a means for adjustably mounting the depending stop relative to the opposed sides. In addition, a mounting means is preferably provided for mounting the depending stop for selective movement into and out of position to engage the mat guide bar.

In the preferred embodiment, the cross member further includes a proximal end located on the opposite side of the bar stop from the distal end. A second depending stop is attached adjacent the proximal end which is also designed to be engaged by the mat guide bar. Preferably, there are a plurality of the cross members. One of the cross members has only the first mentioned depending stop while another cross member has both the first-mentioned depending stop and a second depending stop. Conveniently, the depending stops are a threaded member which is provided in the cross member in a threaded aperture therein.

In the preferred embodiment of the mat cutting system of the present invention, a plurality of blocks are further provided which have block surfaces. A stop surface is also provided on the mat stop. A block means is provided for selectively mounting one or a plurality of the blocks to the stop surface. In this manner, the second engaging surface of each mat stop is the stop surface of the mat stop when no blocks are attached thereto or the outermost surface of one or more block surfaces when one or more blocks is attached thereto. Preferably, the block surfaces are one of two opposed sides which define a thickness of each block, and the blocks are provided in a plurality of different thicknesses. The block mounting means preferably includes a threaded bolt, an aperture in each block through which the bolt is passed, and a threaded aperture in the stop surface in which the bolt is threadably received to hold the block against the stop surface.

It is an advantage of the present invention that the following types of mats are easily laid out and cut: unequal border mats (including single, double, and tripple mats), unequal border mat inlays, multi-openings (both single and double mats), and title openings (both single and double mats).

Other features and advantages of the present invention are stated in or apparent from a detailed description of a presently preferred embodiment of the invention found hereinbelow.

BRIEF DESCRIPTION OF THE DRAWINGS

FIGS. 7A and 7B are, respectively, an exemplary title opening single mat and a schematic representation of a mounting arm and mat guide bar with appropriately located mat bar stops for cutting the title opening mat depicted in FIG. 7A.

DETAILED DESCRIPTION OF THE PREFERRED EMBODIMENT

Figure 1:
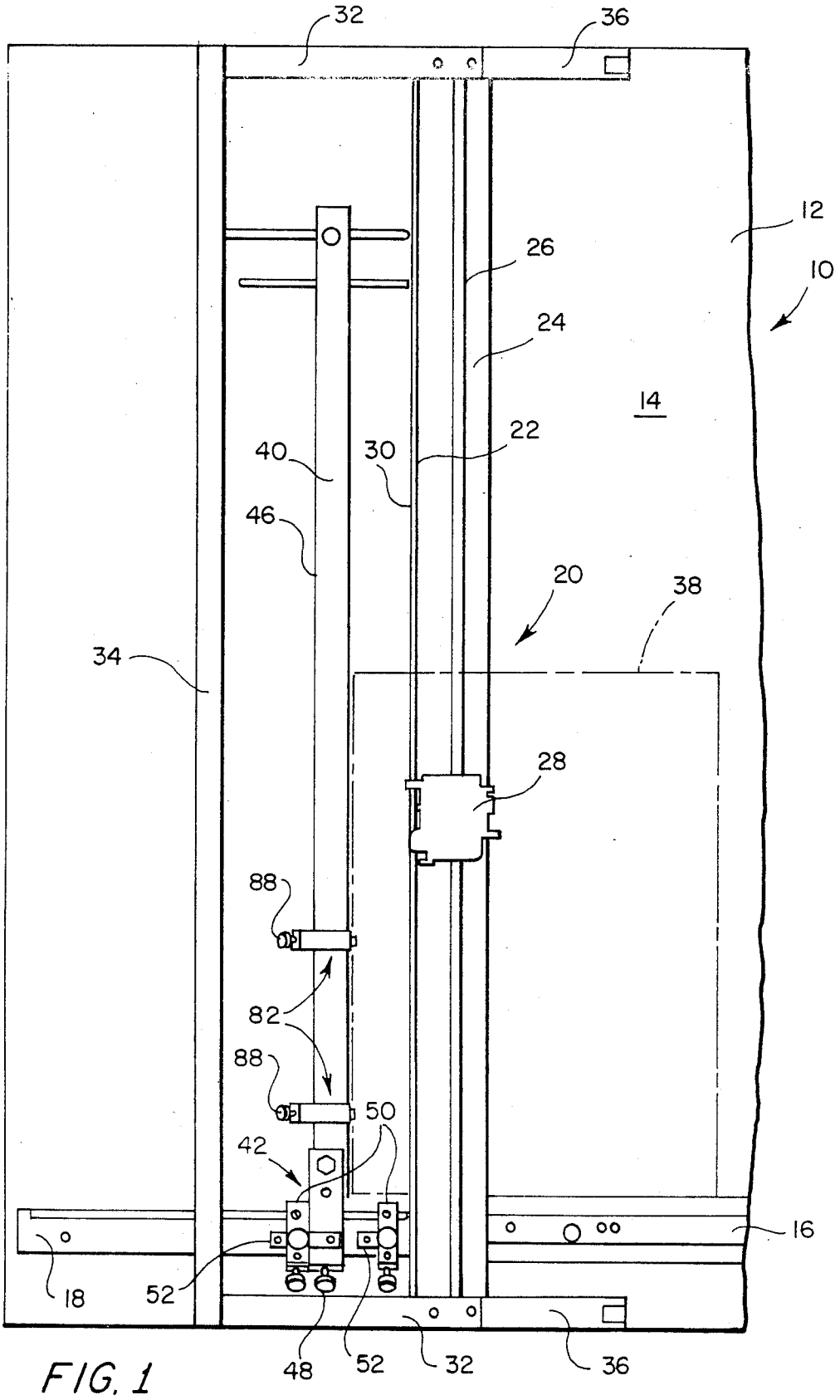
FIG. 1 is a top plan view of the mat cutting system of the present invention.

With reference now to the drawings in which like numerals represent like elements throughout the several views, a mat cutting apparatus 10 according to the present invention is depicted in FIG. 1. Mat cutting apparatus 10 includes a flat base 12 having a base surface 14. Mounted on flat base 12 is a squaring arm 16. Extending parallel to squaring arm 16 is an elongate mounting arm 18. Typically, squaring arm 16 and mounting arm 18 contain measuring indicia thereon.

Extending perpendicularly to squaring arm 16 and mounting arm 18 along base surface 14 is a mat cutter means 20. Mat cutter means 20 includes a guiding edge 22 on a plate 24 and a rod 26 on which a movable cutter 28 is provided. Cutter 28 includes a cutting blade (not shown) which is extendible by the user past guiding edge 22 into a groove 30 provided in flat base 12. Mat cutter means 20 is mounted at each end to supports 32 which are connected to a handle 34. Supports 32 are hingedly mounted to plates 36 which are secured to flat base 12. With this construction, mat cutter means 20 is pivotly mounted relative to base surface 14 such that mat cutter means 20 can be raised out of contact with base surface 14 by raising handle 34. This facilitates the slipping of a mat 38 under mat cutter means 20 and subsequent removal therefrom after cutting.

Mat cutting apparatus 10 further includes a mat guide bar 40 which is attached to mounting arm 18 by a suitable bar mounting means 42. Mat guide bar 40 includes a first mat engaging edge surface 44 and an opposed edge surface 46. As shown in FIG. 1, mat guide bar 40 extends perpendicularly to mounting arm 18 and edge surfaces 44 and 46 are perpendicular to base surface 14 in order to engage an edge of mat 38. Bar mounting means 42 includes a recess therein (not shown) whereby mat guide 40 is slidably mounted for movement along mounting arm 18. Bar mounting means 42 also includes a thumb screw 48 by which mat guide bar 40 is secured in place on mounting bar 18 to prevent sliding movement thereof when mat 38 is being cut.

Base 12, squaring arm 16, mounting arm 18, mat cutter means 20, and mat guide bar 40 are typical of elements used in the art for cutting mat. For example, C & H Manufacturing of Jackson, Miss. produces a model 4060-A mat cutting system similar to that described above.

Figure 2:
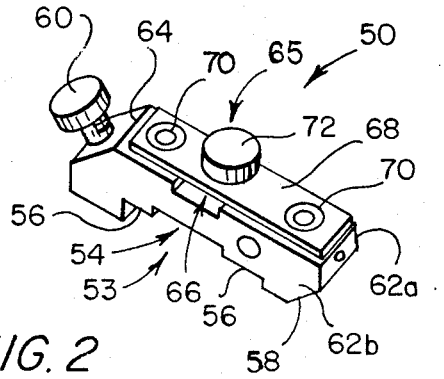
FIG. 2 is a perspective view of a bar stop depicted in FIG. 1.
Figure 3:
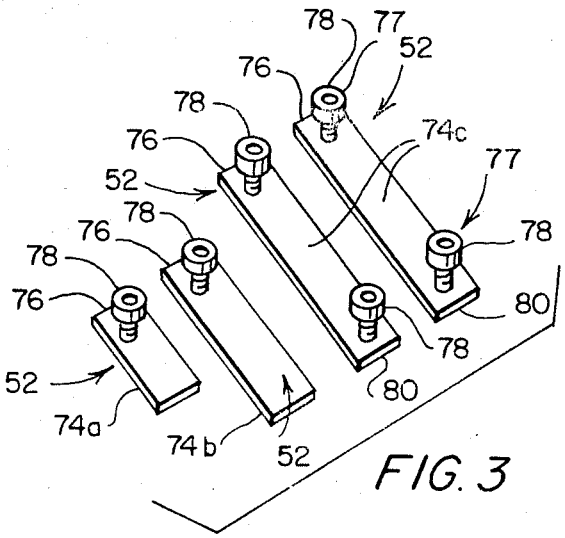
FIG. 3 is a perspective view of various cross members of the present invention.
Figure 4:
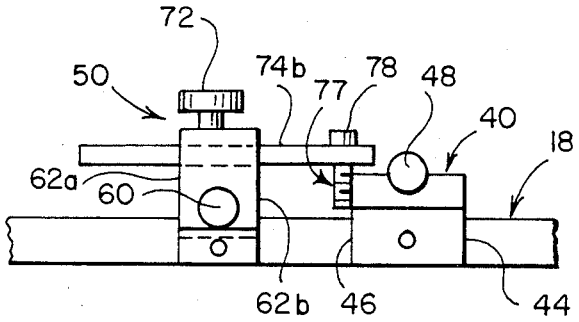
FIG. 4 is an elevation view of a bar stop and cross member in operation.

Mat cutting apparatus 10 of the present invention also includes a plurality of bar stops 50 and associated cross members 52 which are depicted in greater detail in FIGS. 2, 3, and 4. As shown in these figures, each bar stop 50 includes a suitable bar stop mounting means 53 including a recess 54 having landings 56. Landings 56 are designed to slide along mounting bar 18 which is received in recess 54. Bar stop 50 also includes a nose 58 which is beveled as shown in order to facilitate the sliding of mat 38 thereunder, and nose 58 is designed to be located a sufficient distance above base surface 14 to allow mat 38 be located thereunder. At the opposite end of bar stop 50 from nose 58 is a thumb screw 60. Thumb screw 60 is adapted to be threadably received in bar stop 50 in order to engage a ball (not shown) and to push this ball into engagement with mounting arm 18 in order to lock bar stop 50 thereon. When thumb screw 60 is withdrawn from bar stop 50, bar stop 50 is then free to slide along mounting arm 18 upon landings 56.

Located on either side of bar stop 50 are opposed flat side **62*a* and 62*b*. Provided on top side 64 of bar stop 50 is a cross member mounting means 65 including a small recess 66 in top side 64. Small recess 66 is covered by a plate 68 suitably attached to top side 64 by screws 70. Threadably received in plate 68 is a thumb screw 72. The end (not shown) of thumb screw 72 projects into small recess 66 and is withdrawable therefrom. It should be appreciated that small recess 66 is configured to slidably receive a cross member 52** therein.

Cross members 52 are depicted in greater detail in FIG. 3. As shown, cross members 52 are made of various size plates **74*a*, 74*b*, and 74*c*. Plates 74*a* and 74*b* include distal ends 76 having a depending stop 77. Preferably, depending stops 77 take the form of a small thumb screw 78 threadably received in a distal end 76**.

Plates **74*c* similarly receive small thumb screws 78 in distal ends 76 as well as small thumb screws 78 in proximal ends 80. It should be appreciated that in order to mount plates 74*c* in respective recesses 54 of bar stops 50, one of small thumbs screws 78 must be removed in order to slide plate 74*d* into recess 54. After this is accomplished, small thumb screw 78 is then replaced in the end of plate 74*c***.

As shown in FIG. 4, the position of small recess 66 is such that plate **74*b* extends above the top of mat guide bar 18. However, small thumb screw 78 is movable downwardly in plate 74*b*** so that opposed edge surface 46 of mat guide bar 40 abuts against small thumb screw 78.

Figure 5:
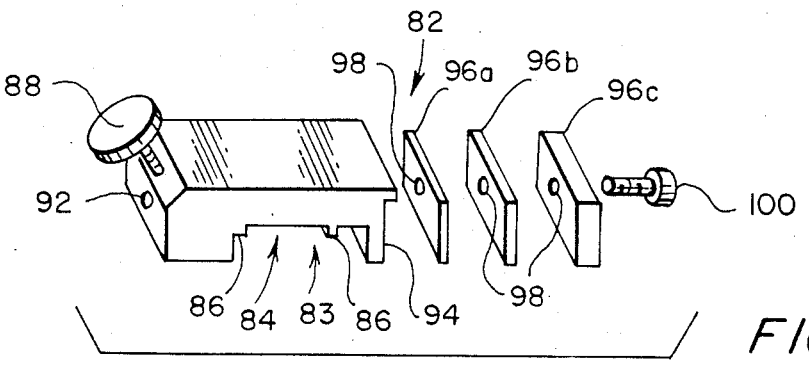
FIG. 5 is a perspective view of a mat stop according to the present invention.

Detachably mounted on mat guide bar 40 are two mat stops 82. As shown in greater detail in FIGS. 5 and 6, each mat stop 82 includes a mat stop mounting means 83. Mat stop mounting means 83 includes a recess 84 and landings 86 such that mat stop 82 receives mat guide bar 40 in recess 84 and slides therealong on landings 86. In order to secure mat stop 82 in a desired position along mat guide bar 40, a thumb screw 88 is provided whose end engages a ball 90 located at the reduced end of an entrance hole 92. As can be appreciated, by advancing thumb screw 88 into mat stop 82, ball 90 is pushed outward from hole 92 into engagement with mat guide bar 40. Similarly, withdrawal of thumb screw 88 releases ball 90 from engagement with mat guide bar 40 so that mat stop 82 is slidable therealong or removable therefrom. It should be appreciated that the operation of thumb screw 88 is similar to the operation of thumb screw 60 and thumb screw 48 described above.

Figure 6:
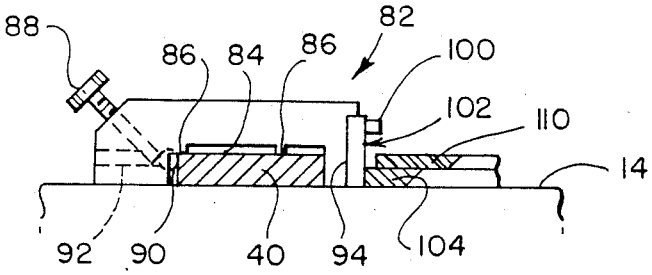
FIG. 6 is an elevation view of the mat stop depicted in FIG. 5 in operation.

Mat stop 82 includes a stop surface 94 which extends parallel to first mat engaging edge surface 44 of mat guide bar 40. Detachably mounted to stop surface 94 is one or more blocks 96*a*, 96*b*, and 96*c* having different thicknesses. Blocks 96*a*, 96*b*, and 96*c* each contain an aperture 98 therein by which blocks 96*a*, 96*b*, and 96*c* are attached to stop surface 94 by a suitable block mounting means such as threaded screw 100. By way of example, the thickness of stop surface 94 is ⅛", the thickness of block 94*a* is 1/16", the thickness of block 96*b* is ⅛", and the thickness of block 96*c* is ¼". Thus, as shown in FIG. 6, when mat stop 82 is mounted on mat guide bar 48 for cutting a double mat, the outermost surface of block 96*b* forms a second mat engaging surface 102 to provide a cut ¼" in from the first cut on the first mat.

In operation, mat cutting apparatus 10 is operated in the following manner which is exemplified by the cutting of a title opening mat 104 as depicted in FIG. 7A. As shown in FIG. 7A, title opening mat 104 has a length dimension of X7 and a width dimension of X6. The distance from the relevant side where openings 106 and 108 are to be cut are indicated by dimensions X1, X2, X3, X4, and X5. It should be appreciated that title opening mat 104 is cut with the surface to be viewed face down on base surface 14 in order to achieve the proper beveled double cut from mat cutter 28 along guiding edge 22 of plate 24.

In order to cut title opening mat 104 with the present invention, four bar stops 50 are mounted on mounting arm 18 at appropriate locations as described below. Bar stop 50*a* is located such that flat side 62*a* is the distance X1 from guiding edge 22. Bar stop 50*b* is located along mounting arm 18 at the position where flat side 62*b* is spaced from guiding edge 22 a distance equal to dimension X3 plus the thickness of mat guide bar 40. This dimension is identified in FIG. 7B as X3'. Bar stop 50*b* includes cross member 52 having plate 74*b* as shown. After small thumb screw 78 is advanced into plate 74*b*, mat guide bar 40 is moved so that first mat engaging edge surface 44 is spaced the distance X2 from guiding edge 22. At this time, the lower part of small thumb screw 78 is moved into abutment with opposed edge surface 46 of mat guide bar 40 and thumb screw 72 of bar stop 50*b* is tightened to maintain plate 74*b* in this position. Bar stop 50*c* is similarly positioned at the location where flat side 60*a* is located at the dimension X4 from guiding edge 22. Finally, bar stop 50*b* is positioned on mounting arm 18 such that flat side 62*b* is spaced the dimension X5 plus the width of mat guide bar 40 from guiding edge 22. This dimension is indicated as X5' in FIG. 7B.

With bar stops 50*a*, 50*b*, 50*c*, and 50*d* secured in place by use of thumb screws 60, title opening mat 104 is then ready to be cut. By loosening thumb screw 48 of mat guide bar 40, first mat engaging surface 44 of mat guide 40 is moved into abutting relationship with flat side 62*a* of bar stop 50*a*. After securing mat guide bar 40 in this position by tightening thumb screw 48, mat 104 is placed flat against first mat engaging surface 44 of mat guide bar 40 and mat cutter means 20 is used to make the cut corresponding to dimension X1 of opening 108. Thereafter, with small thumb screw 78 advanced into plate 74*b*, thumb screw 48 of mat guide bar 40 is loosened and mat guide bar 40 is slid along mounting arm 18 until opposed edge surface 46 engages the depending portion of small thumb screw 78. Thumb screw 48 is then tightened and the corresponding side of title opening mat 104 is placed in engagement with first mat engaging surface 44 so that so that the appropriate three cuts of opening 106 corresponding to dimension X2 are then made in title opening mat 104. Small thumb screw 78 is then withdrawn upward through plate 74*b* until there is clearance for mat guide bar 40 to slide underneath small thumb screw 78. Thumb screw 48 is then loosened and mat guide bar 40 slides along mounting arm 18 until opposed edge surface 46 engages flat surface 62*b* of mat stop 50*b*. Thumb screw 48 is then tightened and the corresponding cuts at dimension X3 of opening 106 in mat 104 is made.

In order to make the cuts in mat 104 corresponding to the dimensions X4 and X5, mat guide bar 40 is removed from mounting arm 18 by loosening thumb screw 48 and moving mat guide bar 40 out from under plate 74*b*. Mat guide bar 40 is then lifted and replaced on mounting arm 18 between bar stops 50*c* and 50*d*. Then, in a similar manner as described above, the cuts in mat 104 at dimensions X4 and X5 are made by moving guide bar 40 into abutting relationship with bar stops 50*c* and 50*d*, respectively.

After cutting title opening mat 104, it should be appreciated that any number of precisely similar title opening mats 104 can subsequently be made by repeating the above procedure. By use of bar stops 50*a*, 50*b*, and 50*c*, and 50*d* and plate 74*b*, very precise and repeatable opening cuts are made in each title opening mat 104.

This ability to repeat a precisely positioned cut in title opening mat 104 also provides the ability of mat cutting apparatus 10 of the present invention to cut a double mat. This is accomplished by initially cutting title opening mat 104 as indicated above. Thereafter, a second mat 110 having slightly smaller overall dimensions than title opening mat 104 is attached face down to the back side of title opening mat 104 which has been appropriately provided with openings 106 and 108. Next, after it is determined how large of a border the second mat is to present with respect to the first, for example ¼", mat stops 82 are appropriately adjusted. Thus, as depicted in FIG. 6, each block 96*b* is attached to respective stop surface 94 using threaded screw 100. Thereafter, both mat stop 82 are attached at appropriate positions on mat guide bar 40. Second mat 110 is then cut in precisely the same manner as title opening mat 104. However, as shown in FIG. 6, the same sides of title opening mat 104 are placed against mat stops 82 instead of against mat guide bar 40. Thus, second mat 110 is shifted ¼" as each separate cut is made so that second mat 110 is cut precisely parallel to openings 106 and 108, but ¼" inside of these openings.

It should be appreciated that the use of mat stops 82 and bar stops 50 together with cross members 52 as desired allows for an extremely accurate positioning of a mat to be cut and of an associated double mat as desired. Thus, where repeatability of a cutting line is of prime importance such as in cutting double mats, mat cutting apparatus 10 is especially useful. Besides double mats, mat cutting apparatus 10 is also usable for triple mats, unequal border mat inlays and multiple openings for both single and double mats. The unique advantages of the present invention are perhaps best realized when used to produce mat inlays. Without the present invention, such mat inlays are invariable slightly missized. However, with the present invention, the inlays are virtually perfectly matched and no imperfections are discernible to the user.

While the present invention has been described with respect to an exemplary embodiment thereof, it will be understood by those of ordinary skill in the art that variations and modifications can be effected within the scope and spirit of the invention.

I claim:

1. A system for the precision cutting of picture mats comprising:

a flat base having a base surface;

an elongate mounting arm attached to said base, said mounting arm extending in a direction parallel to said base surface;

a mat guide bar including a first mat engaging edge surface, an opposed edge surface parallel thereto, and a bar mounting means for adjustably and detachably mounting said mat guide bar to said mounting arm such that said first edge surface and opposed edge surface of said mat guide bar extend perpendicular to the direction of said mounting arm and perpendicularly from said base surface;

a mat cutter means mounted to said base for cutting a mat along a line parallel to said first edge surface of said mat guide bar, said mat cutter means extending parallel to said mat guide bar and along said base surface;

a plurality of bar stops, each said bar stop including opposed flat sides and a bar stop mounting means for detachably mounting each said bar stop to said mounting arm such that said opposed flat sides of said bar stops are positioned parallel to said edge surfaces of said mat guide bar;

two mat stops, each said mat stop including a second mat engaging edge surface, a mat stop mounting means for detachably mounting said mat stop to said mat guide bar with said second mat engaging edge surface parallel to said first mat engaging edge surface, and an adjustment means for adjusting the position of said second edge surface relative to said first edge surface of said mat guide bar;

whereby a rectangular opening having unequal borders is easily cut by moving said mat guide bar from abutting relationship with one of said bar stops to abutting relationship with another said bar stop, and a double mat having a smaller and congruent rectangular opening is similarly cut by placement of appropriately adjusted said two mat stops on said mat guide bar during the cutting of the opening in a first mat and by the subsequent removal of said two mat stops during the cutting of the congruent opening of the double mat.

2. A system for cutting mats a claimed in claim 1 wherein one of said bar stops includes an elongate cross member with a distal end, a cross member mounting means for mounting said cross member to said bar stop such that said cross member extends perpendicular to respective said opposed sides of said bar stop and parallel to said mounting arm with said distal end spaced from said bar stop, and a depending stop attached adjacent said distal end which is engaged by said mat guide bar whereby an additional positioning of said mat guide bar is possible by abutting said mat guide bar against said depending stop.

3. A system for cutting mats as claimed in claim 2 wherein said cross member mounting means includes a means for adjustably mounting said depending stop relative to said opposed sides.

4. A system for cutting mats as claimed in claim 3 wherein said cross member includes a mounting means for mounting said depending stop for selective movement into and out of position to engage said mat guide bar.

5. A system for cutting mats as claimed in claim 4 wherein said cross member further includes a proximal end which is located on the opposite side of said bar stop from said distal end, and a second depending stop attached adjacent said proximal end which is engaged by said mat guide bar.

6. A system for cutting mats as claimed in claim 5 wherein there are a plurality of said cross members, one said cross member having only a said first-mentioned depending stop and another said cross member having both said first-mentioned depending stop and said second depending stop.

7. A system for cutting mats as claimed in claim 4 wherein said depending stop is a threaded member and said mounting means is a threaded aperture in said cross member.

8. A system for cutting mats as claimed in claim 2 wherein said cross member includes a mounting means for mounting said depending stop for selective movement into and out of position to engage said mat guide bar.

9. A system for cutting mats as claimed in claim 1 and further including a plurality of blocks having block surfaces and a stop surface on said mat stop; and wherein said adjustment means is a block mounting means for selectively mounting one or a plurality of said blocks to said surface such that said second engaging surface of each said mat stop is the outermost surface of one of said stop surface on said mat stop and the plurality of block surfaces.

10. A system for cutting mats as claimed in claim 9 wherein said block surfaces are one of two opposed sides defining a thickness of each said block, and wherein said blocks have a plurality of different thicknesses.

11. A system for cutting mats as claimed in claim 10 wherein said block mounting means includes a threaded bolt, an aperture in each block perpendicular to each respective said block surface through which said bolt is passed, and a threaded aperture in said stop surface which is perpendicular to said stop surface for threadably receiving said bolt whereby any said block on said bolt is held against said stop surface.

12. A system for the precision cutting of picture mats comprising:

a flat base having a base surface;

an elongate mounting arm attached to said base, said mounting arm extending in a direction parallel to said base surface;

a mat guide bar including a first mat engaging edge surface, an opposed edge surface parallel thereto, and a bar mounting means for adjustably and detachably mounting said mat guide bar to said mounting arm such that said first edge surface and opposed edge surface of said mat guide bar extend perpendicular to the direction of said mounting arm and perpendicularly from said base surface;

a mat cutter means mounted to said base for cutting a mat along a line parallel to said first edge surface of said mat guide bar, said mat cutter means extending parallel to said mat guide bar and along said base surface;

a plurality of bar stops, each said bar stop including opposed flat sides and a bar stop mounting means for detachably mounting each said bar stop to said mounting arm such that said opposed flat sides of said bar stops are positioned parallel to said edge surfaces of said mat guide bar; and one of said bar stops including an elongate cross member with a distal end, a cross member mounting means for mounting said cross member adjustably to said bar stop such that said cross member extends perpendicular to respective said opposed sides of said bar stop and parallel to said mounting arm with said distal end adjustably spaced from said bar stop, a depending stop, and a mounting means for mounting said depending stop adjustably adjacent said distal end such that said depending stop is adjusted for selective movement into and out of position to engage said mat guide bar;

two mat stops, each said mat stop including (a) a stop surface, (b) a mat stop mounting means for mounting said mat stop to said mat guide bar with said stop surface parallel to said first mat engaging edge surface and adjacent said base surface, (c) a plurality of blocks having block surfaces, (d) a block mounting means for selectively mounting one or a plurality of said blocks to said stop surface whereby said mat stop is provided with an adjustable second mat engaging surface which is the stop surface when no blocks are attached thereto and which is the outermost block surface when one or more blocks is attached thereto;

whereby openings of various configurations are easily cut in picture mats located on said base surface.

* * * * *